US010264869B2

(12) United States Patent
Brouillet et al.

(10) Patent No.: US 10,264,869 B2
(45) **Date of Patent: *Apr. 23, 2019**

(54) DEVICE FOR DISPENSING ARTIFICIAL EYELASHES

(71) Applicant: ALBEA SERVICES, Gennevilliers (FR)

(72) Inventors: Boris Brouillet, L'hay les Roses (FR); Osvaldo Uresti, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/652,503

(22) Filed: Jul. 18, 2017

(65) Prior Publication Data

US 2017/0311701 A1 Nov. 2, 2017

Related U.S. Application Data

(63) Continuation of application No. 14/400,397, filed as application No. PCT/EP2013/059967 on May 14, 2013.

(30) Foreign Application Priority Data

May 15, 2012 (FR) ..... 12 54450
Dec. 13, 2012 (FR) ..... 12 62020

(51) Int. Cl.
*A41G 5/00* (2006.01)
*A45D 44/00* (2006.01)
*A41G 5/02* (2006.01)

(52) U.S. Cl.
CPC ..... *A45D 44/00* (2013.01); *A41G 5/02* (2013.01)

(58) Field of Classification Search
CPC ..... A45D 44/00; A45D 2200/25; A41G 5/02; B65H 37/00; B65H 37/005; B65H 37/007;
(Continued)

(56) References Cited

U.S. PATENT DOCUMENTS 2,503,552 A 4/1950 Hassler
2,667,176 A * 1/1954 Wassmer ..... A41G 5/02 132/216
(Continued)

OTHER PUBLICATIONS

International Search Report and Written Opinion dated Aug. 6, 2013 (PCT/EP2013/059967); ISA/EP; with translation of the ISR.

*Primary Examiner* — Rachel R Steitz
(74) *Attorney, Agent, or Firm* — Banner & Witcoff, Ltd.

(57) ABSTRACT

A device (1) for dispensing artificial eyelashes, including a housing (10) provided with a dispensing opening (11), a carrying strip (30) onto which a plurality of artificial eyelash units (40) are attached, and a movement mechanism capable of being actuated to cause the strip to move (30) in order to convey the artificial eyelash units (40) toward the dispensing opening (11) and enable the artificial eyelash units (40) to exit through the dispensing opening (11). The carrier strip movement mechanism has a spool (21) that is rotatably mounted relative to the housing (10). The winding of the carrier strip (30) around the spool (21) causes the movement of the carrier strip (30). The carrier strip movement mechanism has an actuating member (23) for rotating the spool (21), allowing the carrier strip (30) to be wound around the spool (21). The housing (10) has an opening (12) and the actuating member (23) has a scroll wheel which can be moved via the opening (12).

21 Claims, 5 Drawing Sheets

(58) Field of Classification Search
CPC ..... B65D 83/0083; B65D 83/0823; B65D 83/0829; B65D 83/0835; B65D 83/0847; B65D 83/0864; B65D 83/087; B65D 83/0876
See application file for complete search history.

(56) References Cited

U.S. PATENT DOCUMENTS

| | | | | |
|---|---|---|---|---|
| 3,703,180 | A | 11/1972 | Aylott | |
| 3,935,872 | A | 2/1976 | Aylott | |
| 3,955,711 | A | 5/1976 | Schroter et al. | |
| 4,018,336 | A | 4/1977 | Aylott | |
| 5,005,730 | A | 4/1991 | Pickrell, Jr. et al. | |
| 5,806,714 | A | 9/1998 | Geiger | |
| 5,851,347 | A | 12/1998 | Rodriguez | |
| 6,382,291 | B2 | 5/2002 | Ronalds | |
| 6,394,165 | B1 | 5/2002 | Rader | |
| 6,453,968 | B1 | 9/2002 | Hsu | |
| 6,681,830 | B1 | 1/2004 | Vulpitta et al. | |
| 6,789,551 | B2 | 9/2004 | Iosilevich | |
| 7,887,757 | B2 | 2/2011 | Chan | |
| 2005/0005934 | A1 | 1/2005 | Harvey | |
| 2007/0050207 | A1 | 3/2007 | Merszei | |
| 2007/0272264 | A1 | 11/2007 | Byrne | |
| 2008/0017323 | A1 | 1/2008 | Peterson | |
| 2011/0108199 | A1* | 5/2011 | Miller ..... | A61F 15/002 156/510 |
| 2012/0000957 | A1 | 1/2012 | Martinez | |
| 2013/0152960 | A1 | 6/2013 | Pays et al. | |
| 2014/0216488 | A1 | 8/2014 | Dinh | |
| 2014/0261514 | A1 | 9/2014 | Martins et al. | |
| 2014/0263392 | A1 | 9/2014 | Martins et al. | |
| 2015/0075549 | A1 | 3/2015 | Lee et al. | |

* cited by examiner

DEVICE FOR DISPENSING ARTIFICIAL EYELASHES

CROSS-REFERENCE TO RELATED APPLICATIONS

The present application is a continuation of U.S. application Ser. No. 14/400,397 filed Nov. 11, 2014, which is a U.S. National Phase of International Application No. PCT/EP2013/059967, filed on May 14, 2013, designating the United States of America and claiming priority to French Patent Application No. 1254450, filed May 15, 2012 and French Patent Application No. 1262020, filed Dec. 13, 2012, and this application claims priority to and the benefit of the above-identified applications, each of which is incorporated by reference herein in its entirety.

FIELD OF THE INVENTION

The invention relates to the field of applying make-up, more particularly to the eyes, by adding artificial eyelashes to the natural eyelashes that are more commonly referred to as 'false eyelashes'.

The invention relates to a device for dispensing artificial eyelashes.

PRIOR ART

Artificial eyelashes are generally used to increase the volume, the length or the lustre of natural eyelashes, or to give the face an aesthetic and decorative feature in the same way as a piece of jewelry, for example.

Artificial eyelashes are generally sold in the form of units, each unit comprising a fringe of eyelashes and a connecting strip holding the eyelashes together at their base, the other end of the eyelashes being free. These units can be sold in pairs in conventional boxes which have only changed slightly since they were first used, and have thus been overlooked in the significant innovations made in the field of make-up.

These boxes do not have any particular aesthetic or fun aspects for the consumer which may attract them to one product over another. Indeed, the companies selling these boxes can only distinguish them from other products by colour variations, and cannot give boxes for artificial eyelashes original features in terms of design or function which truly identify the brand of the eyelashes.

Furthermore, these boxes are not very practical as they only provide limited quantities of units of artificial eyelashes, typically a single pair, and this tends to increase the volume occupied by such a box as well as the price of the pair of units of eyelashes sold. These two factors tend to limit the purchase of large quantities of artificial eyelashes.

Moreover, applying units of eyelashes to the eyelids is a delicate operation. First, the user has to apply adhesive to the connecting strip. They must then apply the connecting strip, which has adhesive applied thereto, along the edge of the eyelid at the roots of the natural eyelashes. These steps require the units to be removed by grasping the eyelashes by their free ends, which risks them being damaged.

There is thus a need to extend what is commercially available in terms of boxes containing artificial eyelashes, by proposing an innovative solution which allows both the volume required for storing a pair of units of artificial eyelashes and the unit price of a pair of units of eyelashes to be reduced.

There is also a need to propose boxes for artificial eyelashes that allow units of artificial eyelashes to be handled easily and quickly.

DESCRIPTION OF THE INVENTION

The problem addressed by the invention is that of making it easier to apply artificial eyelashes, while limiting the handling thereof.

This problem is solved within the context of the present invention by a device for dispensing artificial eyelashes, comprising a housing equipped with a dispensing opening, a carrier strip to which a plurality of artificial eyelashes is fixed, and a movement mechanism capable of being actuated to cause movement of the strip in order to convey the artificial eyelashes towards the dispensing opening and to allow the artificial eyelashes to exit through the dispensing opening.

Advantageously, but optionally, the invention may also be supplemented with at least one of the following features:

- the movement mechanism is configured to allow movement of the carrier strip by a member projecting on the outside of the housing; in other words, the movement of the carrier strip is not produced by the mere movement of the housing relative to the carrier from which the eyelashes are intended to be removed,
- the carrier strip movement mechanism comprises a spool that is rotatably mounted relative to the housing, the winding of the carrier strip around the spool causing the movement of the carrier strip,
- the carrier strip movement mechanism comprises an actuating means for rotating the spool, allowing the carrier strip to be wound around the spool,
- the housing comprises an opening and the actuating means comprises a scroll wheel which can be moved via the opening,
- the spool comprises a first toothed wheel, and the actuating means comprises a second toothed wheel capable of meshing with the first toothed wheel,
- the second toothed wheel projects out of the housing so that it can be rotated by the user,
- the movement mechanism comprises a reel that is rotatably mounted relative to the housing, the movement of the strip causing the strip to unwind from the reel,
- part of the carrier strip is wound around the reel to store the plurality of artificial eyelashes,
- the artificial eyelashes are oriented in the direction of the carrier strip,
- the ends of the eyelashes are positioned at a distance from the carrier strip,
- the artificial eyelashes are bonded to the carrier strip in the region of the middle of the eyelashes in the longitudinal direction thereof,
- the artificial eyelashes are fixed to the carrier strip by means of an adhesive coating on the strip,
- the movement mechanism further comprises a deflecting element arranged close to the dispensing opening, and wherein, when moved, the carrier strip passes around the deflecting element while changing direction, causing the eyelashes to be detached from the carrier strip and the detached eyelashes to exit through the opening,
- the deflecting element is positioned at a distance from the dispensing opening that is less than the length of an eyelash,
- the deflecting element has an outer surface on which the carrier strip rests, the outer surface having a radius of curvature of between 0.5 mm and 4 mm, a direction of the carrier strip upstream of the deflecting element and a direction of the carrier strip downstream of the deflecting element form an angle of between 1° and 90°, preferably of between 10° and 50°, the reel has a diameter of between 5 and 12 mm, the artificial eyelashes are assembled into units of eyelashes, the units are fixed to the carrier strip while being spaced apart with a constant interval between two consecutive units, the direction of the eyelashes preferably being parallel to the longitudinal direction of the carrier strip, each unit comprises a fringe of eyelashes and a connecting strip connecting the eyelashes in the fringe, each eyelash being connected to the connecting strip by one end, the other end of the eyelash being free, the connecting strips are oriented orthogonally to said carrier strip, the units are arranged on the carrier strip such that, when the eyelashes are conveyed towards the dispensing opening, the connecting strip is conveyed towards the dispensing opening first, the connecting strips are at a distance from the carrier strip, each unit of artificial eyelashes is bonded to said carrier strip in the region of the middle of the eyelashes in the longitudinal direction thereof, the strip comprises a plurality of separate adhesive regions, each unit of artificial eyelashes being bonded to an adhesive region in the region of the middle of the eyelashes in the longitudinal direction thereof, the units of eyelashes have a width of between 5 and 8 mm, preferably equal to 7.5 mm, the eyelashes have a length of between 8 and 15 mm, preferably equal to 10 mm.

The invention also proposes an assembly for applying artificial eyelashes, the assembly comprising:

at least one device according to any of the preceding claims, a bottle of an adhesive capable of applying adhesive to units of eyelashes, and a bottle of a product capable of dissolving said adhesive.

It is thus possible to design a housing allowing a large number of units of artificial eyelashes to be stored and allowing these units to be dispensed as required.

The device allows a large number of units of artificial eyelashes to be stored in a compact manner and to be dispensed.

In addition, the way the user handles the device gives applying artificial eyelashes a fun aspect, the device being simple and innovative in its operation compared with the boxes that are conventionally used in this field.

DESCRIPTION OF THE DRAWINGS

Other features, aims and advantages of the invention will become clearer from the following description, which is given purely by way of illustrative and non-limiting example and should be read with reference to the accompanying drawings, in which.

DETAILED DESCRIPTION OF AT LEAST ONE EMBODIMENT

Figure 1:
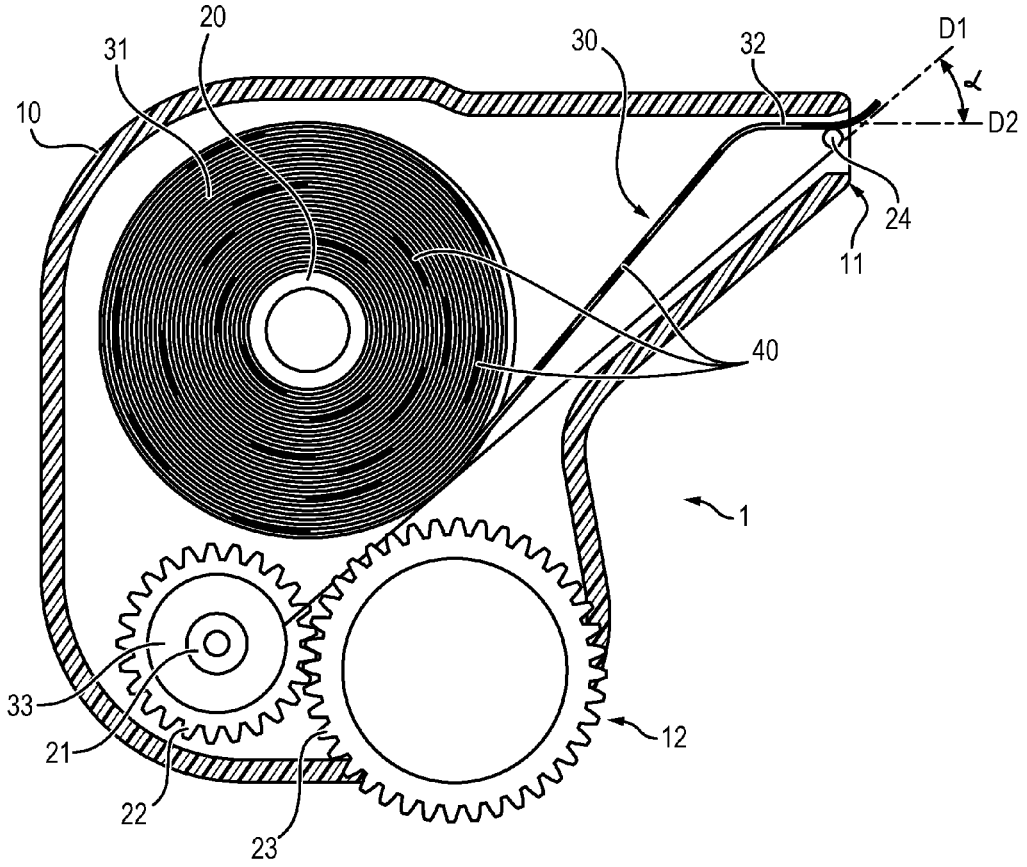
FIG. 1 schematically shows a device for dispensing artificial eyelashes according to an embodiment of the invention.

An example of a device for dispensing artificial eyelashes according to the invention is shown in FIG. 1.

This device 1 comprises a housing 10, preferably made of a plastics material such as polypropylene (PP), polyethylene (PE), acrylonitrile butadiene styrene (ABS), styrene acrylonitrile (SAN) or polyethylene terephthalate (PET), polyethylene terephthalate glycol-modified (PETG), Surlyn® resin or polyoxymethylene (POM). The housing may also be made of metal, such as aluminium, Zamak, etc.

This housing 10 may be transparent, so that the elements that it contains can be seen, or by contrast may be opaque.

The housing 10 is provided with a dispensing opening 11, through which the eyelashes exit in order to be used by an individual, and with an opening 12 allowing, as described above, a dispensing mechanism arranged inside the housing 10 to be actuated.

The dispensing mechanism comprises a carrier strip 30 for artificial eyelashes. A plurality of artificial eyelashes 41 are fixed to this strip 30, these eyelashes preferably being grouped in the form of units 40 of eyelashes.

The fixing of the units to the strip 30 is preferably ensured by an adhesive coating on the strip, the coating having properties suitable for allowing the units 40 that are to be dispensed to be removed without damaging the eyelashes 41.

Figure 2A:
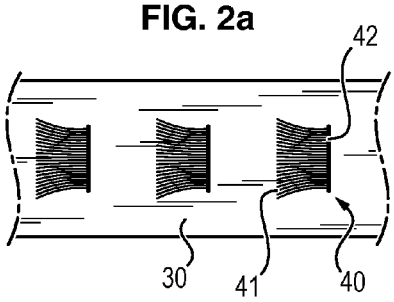
FIG. 2*a* shows a carrier strip to which units of artificial eyelashes are fixed.

With reference to FIG. 2*a*, each unit 40 of eyelashes comprises a fringe of eyelashes 41 and a connecting strip 42. The eyelashes are interconnected at one end, preferably their base, by the connecting strip 42, the other end being free.

The artificial eyelashes 41 and the connecting strip 42 are made of synthetic fibres, typically polybutylene terephthalate (PBT), and are connected to the connecting strip 42 by any known method, for example they may be bonded to or integrally formed with the connecting strip. They may also be sewn to the connecting strip or welded thereto.

Figure 2B:
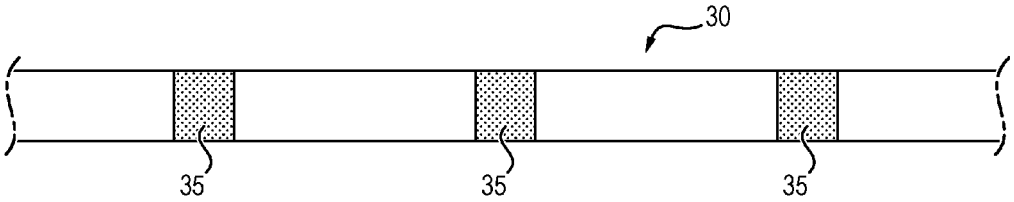
FIG. 2*b* shows a carrier strip without units of artificial eyelashes.

Advantageously, as shown in FIG. 2*b*, the strip 30 has a plurality of separate adhesive regions 35, said regions being for example covered with an adhesive coating, the remainder of the strip not being adhesive.

Figure 2C:
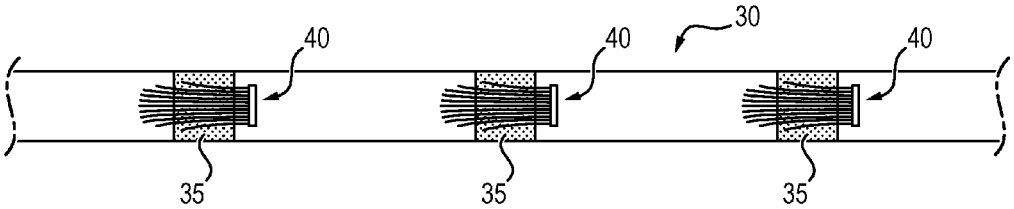
FIGS. 2*c* and 2*d* are a plan view and a side view respectively of the placement of the units of eyelashes on a carrier strip.

The units 40 to be dispensed are bonded to said regions 35, as can be seen in FIG. 2*c*, in the region of the middle of the eyelashes in the longitudinal direction thereof, so as to bond neither the ends of the eyelashes nor the connecting strip. For example, if the eyelashes are 10 mm long, the units of eyelashes may have adhesive applied thereto over a strip of 5 mm that is in the centre over half the length of the eyelashes.

This has several advantages: the ends of the eyelashes are kept separate from one another so that they do not alter the look of the eyelashes once they are in place on the user's eye. Furthermore, the residue of adhesive on the units of eyelashes is reduced compared with completely bonding the eyelashes, and in particular, each free end of the eyelashes is not stuck to the adjacent eyelash. The aesthetics of the units of eyelashes are therefore maintained.

Figure 2D:
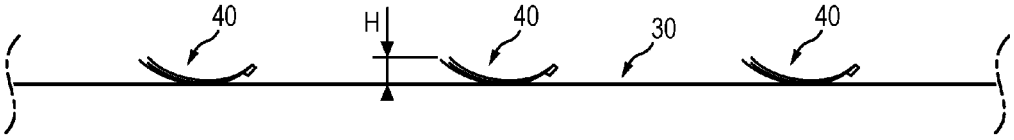

Finally, as can be seen in FIG. 2*d*, since the eyelashes are held by the middle of their length on the strip, their ends protrude less than they would if the eyelashes were fixed to the strip by the other end.

In other words, there is a height H between the end of the eyelashes of a unit and the strip 30 which is reduced compared with the same height H' if the units of eyelashes were bonded to the strip 30 by the connecting strip. These heights are shown by way of illustrative example in FIGS. 2*d* and 5*a* respectively.

Consequently, the ends of the eyelashes are not in contact with a wall of the housing 10 when the eyelashes are moved in the dispenser and can therefore be freely moved in the dispenser.

The units 40 of eyelashes are preferably fixed to the carrier strip 30 such that the eyelashes are oriented in parallel with the longitudinal direction of the carrier strip 30, the connecting strip 42 thus being transverse to this direction.

Furthermore, the units 40 of eyelashes are preferably regularly distributed over the carrier strip 30 such that they are spaced apart by a constant interval between two consecutive units. Typically, this interval may be between 5 and 20 mm.

Figure 3:
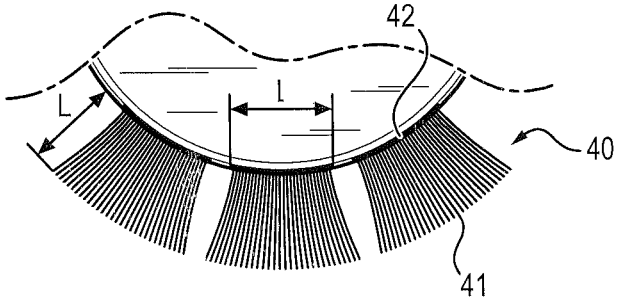
FIG. 3 shows the effect of artificial eyelashes placed on an eyelid.

With reference to FIG. 3, the eyelashes 41 have a length L of between 8 and 15 mm, preferably equal to 10 mm.

The units 40 of eyelashes themselves have a width I of between 4 and 8 mm, preferably of between 4 and 5 mm. This width is less than the units of eyelashes that are conventionally commercially available. As can be seen in FIG. 3, which simulates an individual's eyelid to which units 40 of eyelashes have been applied, it is necessary to apply a plurality of units 40 of eyelashes to the eyelid to cover the total width of the user's eyelid.

The reduction in the width I of the units 40 of eyelashes makes it possible to reduce the width of the carrier strip 30 to which the units are fixed, and as a result the volume occupied by the dispensing device 1.

Again with reference to FIG. 1, the dispensing mechanism comprises a carrier strip movement mechanism to convey the units 40 of eyelashes towards the dispensing opening 11.

The movement mechanism comprises a reel 20, which is rotatably mounted relative to the housing 10. A first longitudinal end of the carrier strip 30 is fixed to the reel, and a part 31 of the strip, to which the units of artificial eyelashes to be dispensed are fixed, is wound around the reel 20. The reel 20 is therefore positioned upstream of the dispensing opening 11, and may even form the starting point of the path of the strip.

The part 31 of the strip that is wound around the reel forms a reserve of units of eyelashes 40. More particularly, the dimensions of the device 1 may allow several meters of carrier strip 30 to be wound, for example between 0.5 and 2 meters of strip, which allows between 60 and 180 units of artificial eyelashes to be stored. This allows a user to have approximately 10 to 30 days' worth of artificial eyelashes.

The length of the strip to be wound around the reel, as well as the diameter of the circular cross section thereof, have to be adapted so that winding the strip around the reel does not alter the radius of curvature of the eyelashes too significantly once dispensed.

For example, if the diameter of the circular cross section of the reel is too low, the eyelashes on the part of the strip closest to the outer surface of the reel will have too high a radius of curvature.

Thus, the diameter of the circular cross section of the reel is between 5 and 12 mm.

Moreover, winding the strip forms a cylinder around the reel, of which the diameter increases progressively with the length of the wound strip. If the length of the wound strip is too great, the diameter of the cylinder thus formed will be too great and the radius of curvature of the eyelashes fixed to the strip at the periphery of the winding will be too low.

The winding length of the strip that is indicated above takes this effect into account. The diameter of the cross section of the cylinder formed by the strip wound around the reel may have a diameter of 30 mm at the most. The dispensing device 1 thus allows a considerable number of units of artificial eyelashes to be stored, contrary to the conventional boxes, and indeed in a highly compact manner, owing to the strip being wound around the reel.

The reel 20 is in the form of a cylinder having a circular cross section, the cylinder being movable in rotation about its axis of revolution and having a length that is greater than or equal to the width of the carrier strip 30. This allows the carrier strip 30 to rest satisfactorily on the outer surface of the cylinder 20.

The reel may be made of the same material as the housing 10.

The system for moving the carrier strip 30 further comprises a spool 21, which is rotatably mounted relative to the housing 10. The spool 21 is downstream of the dispensing opening 11 on the path of the strip.

The second longitudinal end of the carrier strip 30 that is not fixed to the reel is fixed to the spool 21, and a part 33 of the strip, from which the units of eyelashes have been removed, is wound around the spool.

In a manner similar to the reel 20, the spool 21 is in the shape of a cylinder having a circular cross section, the cylinder being movable in rotation about its axis of revolution and having a length that is greater than or equal to the width of the carrier strip 30. This allows the carrier strip 30 to rest satisfactorily on the outer surface of the spool 21.

The spool 21 may be made of the same material as the housing 10.

An intermediate part 32 of the carrier strip 30, located between the part 31 wound around the reel 20 and the part 33 wound around the spool 21, passes close to the dispensing opening 11.

This part 32 rests on a deflecting element 24, in the form of a pin having a circular cross section or a pulley that is rotatably mounted relative to the housing. This deflecting element 24 is arranged close to the dispensing opening 11, that is to say at a distance from the dispensing opening that is less than the length of an eyelash.

The carrier strip 30 is tensioned by the deflecting element, and passes around it while changing direction, in its path between the reel 20 and the spool 21.

The position of the deflecting element 24 and the diameter thereof are adapted so that, when the carrier strip 30 passes around the element 24, the unit 40 of eyelashes is removed in part from the carrier strip 30 and exits the device 1 through the dispensing opening.

For example, a direction D1 of the carrier strip upstream of the deflecting element and a direction D2 of the carrier strip downstream of the deflecting element form an angle α of between 1° and 90°, preferably of between 10° and 50°. The radius of the deflecting element 24 is selected such that its outer surface has a radius of curvature of between 0.5 and 40 mm, so that when the strip passes around the deflecting element while resting on this outer surface, it adopts the same radius of curvature.

Furthermore, the units 40 of eyelashes are arranged on the strip such that the natural curvature of the eyelashes is opposite to the curvature adopted by the carrier strip 30 when it passes around the deflecting element 24.

Figure 4:
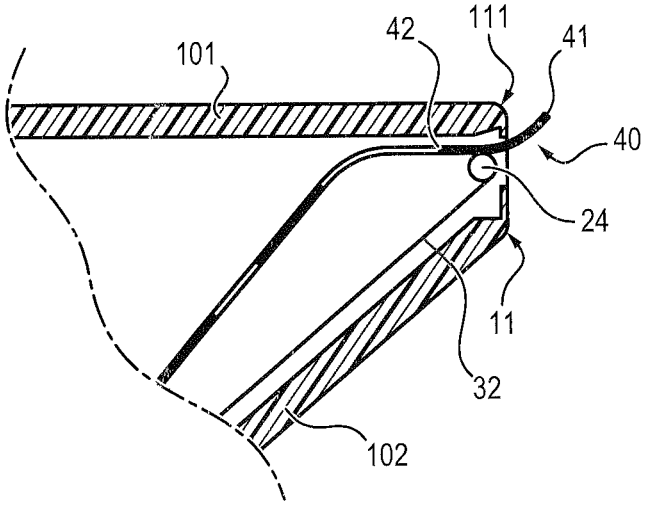
FIG. 4 shows the dispensing opening in the device from FIG. 1.
Figure 5A:
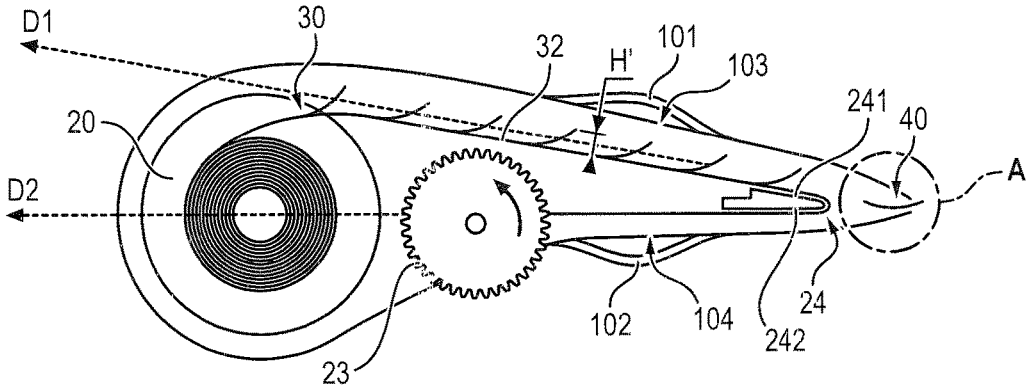
FIG. 5*a* shows an alternative embodiment of the device for dispensing artificial eyelashes.

Thus, as can be seen in FIGS. 4 and 5*a*, when the strip reaches the deflecting element and changes direction by pivoting about said element, the end of the unit 40 located downstream is removed from the strip 30, and exits through the dispensing opening 11.

In the embodiment in FIG. 5*a*, the deflecting element 24 is not a pin or a pulley but a fixed element comprising two surfaces 241, 242 oriented in the above-described directions D1 and D2 and thus forming an angle α therebetween. In this case, the first surface forms a support for the strip 30 before it passes around the deflecting element.

The units 40 to be dispensed are preferably arranged on the carrier strip such that, when the carrier strip is moved towards the dispensing opening, the connecting strips 42 of the eyelashes 41 are conveyed towards the dispensing opening first.

In this way, it is the connecting strip 42 that is removed from the carrier strip 30 and that exits the device through the dispensing opening 11. The free end of the eyelashes, however, remains bonded to the strip.

When the strip is in this position, the user can remove the connecting strip 42 before manually removing the unit from the device 1. During this removal step, the unit 40 is therefore held on the carrier strip 30 by the free end of the eyelashes, and the user does not need to hold the eyelashes in their hand. This results in a lower risk of the artificial eyelashes being damaged while being removed.

Figure 5B:
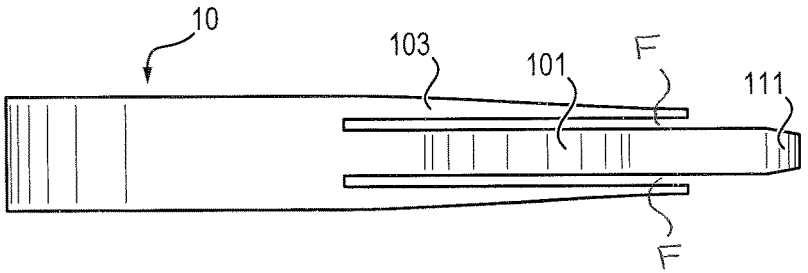
FIG. 5*b* is a plan view of this embodiment and FIG. 5*c* is a view of a detail of the dispensing opening, delimited by the region A shown in FIG. 5*a*.
Figure 5C:
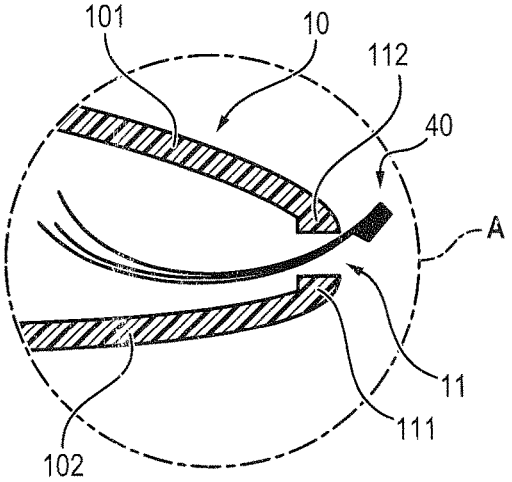

Moreover, in order to make it easier to handle the unit 40 of eyelashes for the purposes of applying adhesive thereto and of applying them, the edges 111, 112 of the dispensing opening 11 made in the housing 10 are preferably in the form of tweezers, as shown in FIGS. 4, 5*a* and 5*c*.

The edges 111, 112 of the dispensing opening 11 may thus comprise two protrusions oriented towards each other and arranged opposite each other on either side of the opening 10 through which the units of false eyelashes exit.

Preferably, the walls 101, 102 of the housing 10 that are arranged in the extension of said edges are flexible so as to be deformable such that the user can, using pressure, deform these walls to bring the two protrusions of the tweezers closer to each other.

A preferred embodiment of these flexible walls 101, 102 is shown in FIGS. 5*a* and 5*b*. The regions of the housing that are located on either side of the intermediate part 32 of the strip 30, in the extension of the edges 111, 112 of the opening 11, are referred to as the upper region 103 and the lower region 104. These regions extend along surfaces extending in parallel with the axes of rotation of the spool and the reel.

In each of these regions, slots F are made which allow the flexible walls 101, 102 to be detached in part from the remainder of these regions, by only holding said walls so as to be connected to said regions by one end. The slots F are advantageously substantially mutually parallel so as to give the flexible walls the shape of a tab.

The flexible walls 101, 102, extended by the edges 111, 112, are resiliently deformable and a user can, by exerting pressure thereon, bring the edges closer together to grasp a unit of eyelashes and hold it in position for the step of applying adhesive or applying it to an eyelid.

Preferably, the flexible walls may also be shaped, as shown in FIG. 5*a*, so as to project from the housing 10. Therefore, a user can press down more easily on the walls 101, 102 and press them towards each other in order to bring the edges 111, 112 of the opening closer together without the fixed regions 103, 104 of the housing counteracting this movement.

In the embodiment shown in FIG. 5*a*, the flexible walls 101, 102 are arranged at distance of between 30 and 50 mm, advantageously 40 mm, from the dispensing opening 11.

To ensure the flexibility of the walls, they may also be made of the same material as the rest of the housing, which is more rigid but has a lower thickness in order to provide this flexibility.

Alternatively, they may be made of a material that is more flexible than the rest of the housing.

Furthermore, the position of the reel 20 relative to the dispensing opening 11 may, in a non-limiting manner, be defined such that the length of the carrier strip 30 between the reel 20 and the dispensing opening 11 has a sufficient quantity of units of eyelashes 40 to cover one eye or both eyes, so that the units of eyelashes 40 applied to the same eye or both eyes have an identical curvature.

By way of non-limiting example, the following parameters are taken into consideration:

- on the carrier strip 30, there is a spacing of 5 mm between two consecutive units of eyelashes 40,
- the units of eyelashes 40 have a width I of 5 mm, such that three units of artificial eyelashes are required to cover one eyelid,
- the eyelashes have a length L equal to 10 mm.

In this case, so that the part of the carrier strip 30 tensioned between the reel and the dispensing opening 11 comprises enough units of eyelashes 40 for the two eyes, i.e. six units of eyelashes, the distance between the reel and the deflecting element has to be greater than or equal to 90 mm. This distance is reduced to 45 mm so that this part of the carrier strip 30 comprises enough units of eyelashes for a single eye.

In operation, the part of the carrier strip 30 located downstream of the deflecting element 24 no longer holds any units of eyelashes because they have been removed through the dispensing opening. This part of the carrier strip is conveyed as far as the spool 33.

Finally, in order to cause the carrier strip 30 to be moved, the dispensing device 1 further comprises an actuating mechanism 23, comprising a scroll wheel which can be moved via the opening 12.

The scroll wheel 23 may comprise a toothed wheel which projects out of the housing 10 through the opening 12. The spool 21 therefore comprises a toothed wheel 22 which meshes with the toothed wheel of the scroll wheel 23 when a user turns the scroll wheel.

The meshing causes the spool 21 to rotate and the carrier strip 30 to be wound around the spool. This winding causes the part of the carrier strip 30 extending between the reel 20 and the spool 21 to be moved, and therefore causes the units of eyelashes 40 to be conveyed towards the dispensing opening, accompanied by the removal of the eyelashes in the region of the above-described dispensing opening. This movement causes the carrier strip to be unwound from the reel 20.

A mechanism for blocking the scroll wheel 23 in one direction of rotation can also be provided such that the user cannot rotate said wheel in the direction in which the spool 21 unwinds.

In the embodiment shown in FIG. 5*a*, the scroll wheel 23 is connected to and concentric with the spool 21 (not shown in this figure), such that when it is rotated, it directly causes the spool to rotate thereon and causes the strip to be wound onto said spool.

Figure 6:
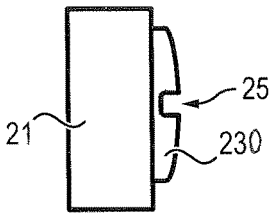
FIG. 6 is a profile view of a spool used in the device from FIG. 1 or FIG. 5*a*.

Alternatively, the actuating mechanism comprising the two meshing toothed wheels may be replaced with a button 230 projecting from the spool 21, the button 230 being mounted so as to be adjacent to a cross section through the end of the spool 21. This alternative is shown schematically in profile in FIG. 6. The button 230 is therefore accessible via an opening 12 in the housing 10 and is equipped with a slot 25 in which a user can place their fingernail in order to directly rotate the spool.

Using this actuating mechanism 23, the user can precisely move the strip in order to obtain a specific number of units 40 of eyelashes.

The device 1 according to the invention allows a large number of units of eyelashes to be stored in and distributed from a limited volume. Furthermore, the strip movement mechanism allows use which is both fun and practical, since it prevents the eyelashes from being damaged while they are being handled. The units of eyelashes stored inside the housing between the turns of the strip wound around the reel are protected, the user not being able to access the interior of the housing.

Figure 7:
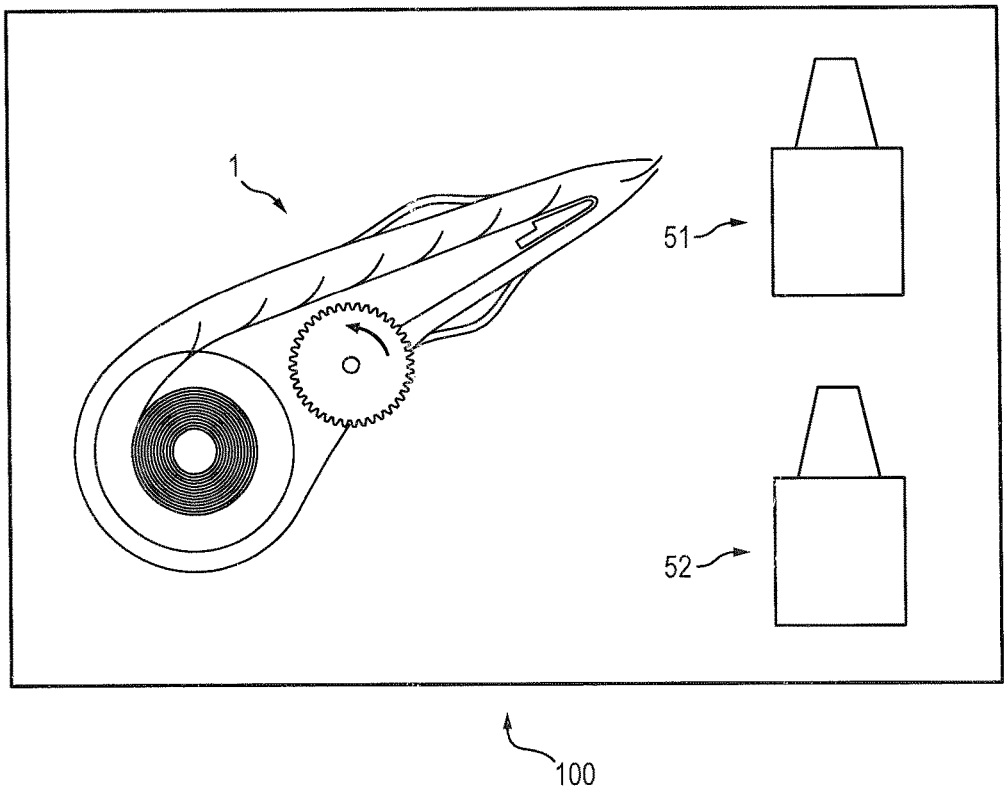
FIG. 7 shows a kit for applying artificial eyelashes comprising a dispensing device according to the invention.

As shown in FIG. 7, it is conceivable for one or more devices 1 to be sold as part of a complete kit 100 for applying artificial eyelashes, the kit further comprising a bottle 51 of adhesive for applying adhesive to the connecting strip 42 of the units of eyelashes 40, and a bottle 52 of dissolving solution for dissolving said adhesive.

The invention claimed is:

1. Device for dispensing artificial eyelashes, comprising a housing equipped with a dispensing opening, a carrier strip to which a plurality of artificial eyelashes are fixed, and a movement mechanism configured to be actuated to cause movement of the carrier strip in order to convey the artificial eyelashes towards the dispensing opening and to allow the artificial eyelashes to exit through the dispensing opening, wherein the carrier strip movement mechanism comprises a spool that is rotatably mounted relative to the housing, the winding of the carrier strip around the spool causing the movement of the carrier strip, wherein the carrier strip movement mechanism comprises an actuating means for rotating the spool, allowing the carrier strip to be wound around the spool, and wherein the housing comprises an opening and the actuating means comprises a scroll wheel which can be moved via the opening, the scroll wheel being directly connected to, and concentric with, the spool, such that when said scroll wheel is rotated, it directly causes the spool to rotate thereon and causes the carrier strip to be wound around onto said spool, wherein the device further comprises a mechanism for blocking the scroll wheel in one direction of rotation.

2. Dispensing device according to claim 1, wherein the movement mechanism is configured to allow movement of the carrier strip by a member projecting on the outside of the housing.

3. Device according to claim 1, wherein the movement mechanism comprises a reel that is rotatably mounted relative to the housing, the movement of the carrier strip causing the carrier strip to unwind from the reel.

4. Device according to claim 3, wherein part of the carrier strip is wound around the reel to store the plurality of artificial eyelashes.

5. Device for dispensing artificial eyelashes according to claim 1, wherein the artificial eyelashes are oriented in the direction of the carrier strip.

6. Device for dispensing artificial eyelashes according to claim 1, wherein ends of the eyelashes are positioned at a distance from the carrier strip.

7. Device for dispensing artificial eyelashes according to claim 1, wherein the artificial eyelashes are bonded to the carrier strip in the region of the middle of the eyelashes in the longitudinal direction thereof.

8. Device for dispensing artificial eyelashes according to claim 1, wherein the artificial eyelashes are fixed to the carrier strip by means of an adhesive coating on the carrier strip.

9. Device for dispensing artificial eyelashes according to claim 1, wherein the movement mechanism further comprises a deflecting element arranged close to the dispensing opening, and wherein, when moved, the carrier strip passes around the deflecting element while changing direction, causing the eyelashes to be detached from the carrier strip and the detached eyelashes to exit through the opening.

10. Device for dispensing artificial eyelashes according to claim 9, wherein the deflecting element is positioned at a distance from the dispensing opening that is less than the length (L) of one of the artificial eyelashes.

11. Device according to claim 9, wherein the deflecting element has an outer surface on which the carrier strip rests, the outer surface having a radius of curvature of between 0.5 and 4 mm.

12. Device according to claim 9, wherein a direction of the carrier strip upstream of the deflecting element and a direction of the carrier strip downstream of the deflecting element form an angle ($\alpha$) of between 1° and 90°.

13. Device according to claim 9, wherein a direction of the carrier strip upstream of the deflecting element and a direction of the carrier strip downstream of the deflecting element form an angle ($\alpha$) of between 10° and 50°.

14. Device according to claim 1, wherein edges of the dispensing opening are in the shape of tweezers and extend flexible walls of the housing to allow the tweezers to be closed and the eyelashes to be held.

15. Device for dispensing artificial eyelashes according to claim 1, wherein the artificial eyelashes are assembled into units of artificial eyelashes.

16. Device for dispensing artificial eyelashes according to claim 15, wherein each unit of artificial eyelashes comprises a fringe of eyelashes and a connecting strip connecting the eyelashes in the fringe, each eyelash being connected to the connecting strip by one end, the other end of the eyelash being free.

17. Device for dispensing artificial eyelashes according to claim 16, wherein the connecting strips are oriented orthogonally to said carrier strip.

18. Device for dispensing artificial eyelashes according to claim 16, wherein the connecting strips are at a distance from the carrier strip.

19. Device for dispensing artificial eyelashes according to claim 15, wherein each unit of artificial eyelashes is bonded to said carrier strip in the region of the middle of the eyelashes in the longitudinal direction thereof.

20. Device for dispensing artificial eyelashes according to claim 15, wherein the carrier strip comprises a plurality of separate adhesive regions, each unit of artificial eyelashes being bonded to an adhesive region in the region of the middle of the eyelashes in the longitudinal direction thereof.

21. Assembly for applying artificial eyelashes, comprising:

at least one device according to claim 15, a bottle of an adhesive configured to apply adhesive to the units of eyelashes, and a bottle of a product capable of dissolving said adhesive.

* * * * *